US008160890B2

(12) United States Patent
Tsushima et al.

(10) Patent No.: US 8,160,890 B2
(45) Date of Patent: Apr. 17, 2012

(54) AUDIO SIGNAL CODING METHOD AND DECODING METHOD

(75) Inventors: Mineo Tsushima, Nara (JP); Akihisa Kawamura, Osaka (JP)

(73) Assignee: Panasonic Corporation, Osaka (JP)

( * ) Notice: Subject to any disclaimer, the term of this patent is extended or adjusted under 35 U.S.C. 154(b) by 610 days.

(21) Appl. No.: 12/438,915

(22) PCT Filed: Dec. 5, 2007

(86) PCT No.: PCT/JP2007/073503
§ 371 (c)(1),
(2), (4) Date: Feb. 25, 2009

(87) PCT Pub. No.: WO2008/072524
PCT Pub. Date: Jun. 19, 2008

(65) Prior Publication Data

US 2010/0042415 A1 Feb. 18, 2010

(30) Foreign Application Priority Data

Dec. 13, 2006 (JP) ..... 2006-335399

(51) Int. Cl.
*G10L 19/00* (2006.01)
*G10L 19/14* (2006.01)

(52) U.S. Cl. ..... 704/500; 704/211; 704/225

(58) Field of Classification Search ..... None
See application file for complete search history.

(56) References Cited

U.S. PATENT DOCUMENTS 6,636,829 B1 * 10/2003 Benyassine et al. ..... 704/201
7,752,039 B2 * 7/2010 Bessette ..... 704/223
7,953,595 B2 * 5/2011 Xie et al. ..... 704/200.1
2003/0046064 A1 3/2003 Moriya et al.

(Continued)

FOREIGN PATENT DOCUMENTS

JP 2002-26738 1/2002

(Continued)

OTHER PUBLICATIONS

International Search Report issued Mar. 11, 2008 in the International (PCT) Application of which the present application is the U.S. National Stage.

(Continued)

*Primary Examiner* — Brian Albertalli
(74) *Attorney, Agent, or Firm* — Wenderoth, Lind & Ponack, L.L.P.

(57) ABSTRACT

It possible not only to reduce a delay, but also to enhance the coding efficiency and reduce audio artifact upon coding.
An audio signal coding method for coding an audio signal to be coded, the method comprising: judging for each of frames whether or not coding should be performed on each of two or more subframes into which the frame is divided, based on an audio signal contained in the frame into which the audio signal to be coded is divided for every set of samples; and when judged that the coding should be performed on each of the subframes, performing, for each subframe, subframe processing of (i) determining a value representing a characteristic of an audio signal of the subframe, and (ii) coding the audio signal using the determined value, wherein in the performing of the subframe processing, whether or not all the values determined for the subframes are the same is judged, and when all the values are the same, the audio signal is coded as exceptional processing, using a characteristic different from characteristics of audio signals indicated by the values.

10 Claims, 13 Drawing Sheets

U.S. PATENT DOCUMENTS

| | | | | |
|---|---|---|---|---|
| 2007/0016402 | A1 | 1/2007 | Schuller et al. | |
| 2007/0083362 | A1 | 4/2007 | Moriya et al. | |
| 2010/0023322 | A1* | 1/2010 | Schnell et al. | 704/211 |

FOREIGN PATENT DOCUMENTS

| | | |
|---|---|---|
| JP | 2003-332914 | 11/2003 |
| JP | 2005-49429 | 2/2005 |
| JP | 2005-165183 | 6/2005 |
| JP | 2005-260373 | 9/2005 |
| WO | 2005/078705 | 8/2005 |

OTHER PUBLICATIONS

*"Perceptual Audio Coding Using Adaptive Pre- and—Post-Filters and Lossless Compression"*, IEEE Transactions on Speech and Audio Processing, vol. 10, No. 6, pp. 379-390, Sep. 2002.

* cited by examiner

FIG. 6

| syntax | number of bits |
|---|---|
| NumDiffGain = 0 ; | |
| ***bs_multi_gain*** | 1 |
| if ( *bs_multi_gain* != 0 ){ | |
| for( num = 1 ; num < NUM_GAIN ; num++ ){ | |
| ***bs_same_gain[num]*** | 1 |
| NumDiffGain += *bs_same_gain[num];* | |
| } | |
| } | |
| ***bs_gain[0]*** | numGainBits |
| if ( *bs_multi_gain* ){ | |
| if ( NumDiffGain == 0 ){ /* monotone increasing */ | |
| ***bs_mono_delta*** | numMonoDeltaBits |
| }else{ | |
| for( num = 0; num < NumDiffGain ; num++ ){ | |
| ***bs_delta[num]*** | numDeltaBits |
| } | |
| } | |
| } | |

FIG. 10

| Syntax | Number of bits |
|---|---|
| ics_info() | |
| { | |
| ics_reserved_bit | 1 |
| window_sequence | 2 |
| window_shape | 1 |
| if( window_sequence== EIGHT_SHORT_SEQUENCE ) { | |
| max_sfb | 4 |
| scale_factor_grouping | 7 |
| } | |
| else { | |
| max_sfb | 6 |
| predictor_data_present | 1 |
| if (predictor_data_present ) { | |
| predictor_reset | 1 |
| if (predictor_reset) { | |
| predictor_reset_group_number | 5 |
| } | |
| for (sfb=0; sfb<min(max_sfb, PRED_SFB_MAX);sfb++) { | |
| prediction_used[sfb] | 1 |
| } | |
| } | |
| } | |
| } | |

FIG. 11

| syntax | number of bits |
|---|---|
| NumDiffGain = 0 ; | |
| ***bs_multi_gain*** | 1 |
| if ( *bs_multi_gain* != 0 ){ | |
| for( num = 1 ; num < NUM_GAIN ; num++ ){ | |
| ***bs_same_gain[num]*** | 1 |
| NumDiffGain += *bs_same_gain[num];* | |
| } | |
| } | |
| ***bs_gain[0]*** | numGainBits |
| if ( *bs_multi_gain* ){ | |
| if ( NumDiffGain == 0 ){ /* monotone increasing */ | |
| ***bs_num_cont*** | numSubFrBits |
| ***bs_mono_delta*** | numMonoDeltaBits |
| }else{ | |
| for( num = 0; num < NumDiffGain ; num++ ){ | |
| ***bs_delta[num]*** | numDeltaBits |
| } | |
| } | |
| } | |

AUDIO SIGNAL CODING METHOD AND DECODING METHOD

TECHNICAL FIELD

The present invention relates to an audio signal coding method and decoding method.

BACKGROUND ART

Among conventional audio signal coding methods and decoding methods, an international standard scheme of the ISO/IEC, commonly called MPEG (Moving Picture Experts Group) scheme, is well known. Currently, ISO/IEC 14496-3, commonly called MPEG-4 GA (General Audio Coding), is one of the coding schemes that are widely applicable and achieve high quality sound even at low bit rates (see Non-Patent Reference 1). There are many extended specifications of this scheme that are currently being standardized.

Among them is a low-delay technique for reducing a delay that occurs in coding and decoding. An example is the Low Delay AAC (Advanced Audio Coding) scheme defined by MPEG-4 Audio (ISO/IEC 14496-3) which is an ISO/IEC international standard. Other examples include techniques disclosed by Patent Reference 1 and Non-Patent Reference 2.

Hereinafter, a conventional audio signal coding method and decoding method of Non-Patent Reference 2 shall be described.

FIG. 1 is a configuration diagram of a conventional audio signal coding apparatus. An audio signal coding apparatus 100 in the figure is an apparatus characterized particularly in reducing a delay in its processing. The audio signal coding apparatus 100 includes an auditory redundancy eliminating unit 101 and an information redundancy eliminating unit 102.

The auditory redundancy eliminating unit 101 eliminates auditory redundancy from an input audio signal. More specifically, it eliminates components that are inaudible by humans from the audio signal based on aural characteristics of humans. The auditory redundancy eliminating unit 101 includes an auditory model 103, a pre-filtering unit 104, and a quantizing unit 105.

The auditory model 103 is an important element for determining the audio artifact of coded audio signals. It screens the sounds and levels of frequency components inaudible by humans, by using a technique well known to those skilled in the art, such as temporal masking or simultaneous masking. As a result, it adaptively calculates the level, in each frequency band, of the sounds of frequency components audible by humans, for input audio signals. The auditory model 103 outputs to the pre-filtering unit 104 information indicating, based on the calculation result, what kind of filter the pre-filtering unit 104 should use. Meanwhile, the auditory model 103 outputs the information after including it in a coded sequence of an audio signal which is an output signal of the audio signal coding apparatus. The auditory model 103 is for example an auditory model described in the specification of the MPEG-1 Layer III (commonly called MP3). An input digital audio signal sequence is first inputted to the auditory model 103.

Based on the information provided by the auditory model 103 indicating what kind of filter should be used, that is, based on a value indicating the level, in each band, of frequency components audible by humans, the pre-filtering unit 104 eliminates with a filter the sounds of the components at the level inaudible by humans from the input digital audio signal sequence. By doing so, the pre-filtering unit 104 outputs an audio signal sequence with no inaudible components. The pre-filtering unit 104 is structured with plural linear prediction filters as disclosed in Non-Patent Reference 2.

The quantizing unit 105 quantizes the audio signal sequence received from the pre-filtering unit 104 by rounding off values less than an integer, and outputs an audio signal sequence which is an integer.

In such a manner, the auditory redundancy eliminating unit 101 eliminates, from input audio signal sequences, components inaudible by humans, and outputs audio signal sequences that are quantized into an integer.

The information redundancy eliminating unit 102 eliminates redundant information from the audio signal sequences received from the auditory redundancy eliminating unit 101 so as to enhance the coding efficiency. The information redundancy eliminating unit 102 includes a lossless coding unit 106.

The lossless coding unit 106 has conventionally been proposed, and employs a method such as Huffman coding, a technique well known by those skilled in the art. The audio signal sequences inputted to the lossless coding unit 106 are previously quantized into integers by the above mentioned quantizing unit 105. So, the lossless coding unit 106 which performs Huffman coding, for example, eliminates redundant information from the integers so as to enhance the coding efficiency.

With the above structure, the conventional audio signal coding apparatus 100 outputs both of the following as a coded sequence: information indicating what kind of prefilter was used by the pre-filtering unit 104, that is, information indicating the linear prediction coefficients that structure the pre-filtering unit 104; and an audio signal sequence (information) coded by the lossless coding unit 106.

Next, a conventional audio signal decoding apparatus shall be described.

FIG. 2 is a configuration diagram of a conventional audio signal decoding apparatus. An audio signal decoding apparatus 200 in the figure decodes an audio signal which has been coded. The audio signal decoding apparatus 200 includes a lossless decoding unit 201 and a post-filtering unit 202.

The lossless decoding unit 201 decodes an audio signal sequence by performing lossless-decoding on a coded sequence outputted from the lossless coding unit 106.

The post-filtering unit 202 structures a postfilter (inverse of the filter used by the pre-filtering unit 104) from a decoded, linear prediction coefficient sequence. The post-filtering unit 202 post-filters the audio signal sequence which has been lossless-decoded by the lossless decoding unit 201, to eventually output an audio signal sequence obtained through the post-filtering.

By using the audio signal coding apparatus of FIG. 1 and the audio signal decoding apparatus of FIG. 2 in the above manner, the delay is made smaller than in the case of using the coding and decoding methods such as AAC. This is because there is no longer a delay for a batch orthogonal transformation process in which one frame of the scheme such as AAC has 1024 samples, for example, and the delay from the pre-filtering and post-filtering is small. As a consequence, a low delay can be achieved.

Patent Reference 1: International Patent Application Publication No. WO2005/078705

Non-Patent Reference 1: ISO/IEC 14496-3: 2005 "General Audio Coding"

Non-Patent Reference 2: Conference Paper "Perceptual Audio Coding Using Adaptive Pre- and Post-Filters and Lossless Compression" (IEEE Transaction on Speech and Audio Processing, vol. 10, No. 6, September 2002)

DISCLOSURE OF INVENTION

Problems that Invention is to Solve

However, the above conventional audio signal coding method and decoding method entail the following problems:

For example, although techniques such as the Low Delay AAC that is an MPEG standard achieve a low delay as the techniques using the AAC scheme, the delay is still 60 ms approximately. Even with a further improvement incorporated, a delay of approximately 40 ms occurs. This is a problem that such a delay is not small enough for bi-directional communications.

Meanwhile, although the technique of Non-Patent Reference 2 reduces the delay to approximately 10 ms, it has a problem that the rate cannot be lowered. Further, the quantizing processing performed on input audio signals by the quantizing unit 105 is performed on a frame-by-frame basis. Thus, when an input audio signal sequence has great temporal fluctuations, the quantization noise (audio artifact caused by coding) created by the quantizing unit 105 cannot be controlled appropriately. In addition, there is also a problem that sufficient coding efficiency cannot be ensured by the lossless coding unit 106.

In view of the above, the present invention has been conceived to solve the above problems, and an object of the present invention is to provide an audio signal coding method and decoding method which can, not only reduce the delay, but also enhance the coding efficiency and reduce audio artifact upon coding.

Means to Solve the Problems

In order to solve the above problems, the audio signal coding method of the present invention is an audio signal coding method for coding an audio signal to be coded, the method comprising: judging for each of frames whether or not coding should be performed on each of two or more subframes into which the frame is divided, based on an audio signal contained in the frame into which the audio signal to be coded is divided for every set of samples; when judged that the coding should not be performed on each of the subframes, performing, for each of the frames, frame processing of (i) determining a first value representing a characteristic of an audio signal of the frame, and (ii) coding the audio signal using the determined first value; and when judged that the coding should be performed on each of the subframes, performing, for each subframe, subframe processing of (i) determining a second value representing a characteristic of an audio signal of the subframe, and (ii) coding the audio signal using the determined second value, wherein in the performing of the subframe processing, whether or not all the second values determined for the subframes are the same is judged, and when all the second values are the same, the audio signal is coded as exceptional processing, with at least one of the second values being a different value.

This makes it possible not only to reduce the delay, but also enhance the coding efficiency and reduce audio artifact upon coding. In addition, the function of executing exceptional processing is included, allowing utilization of meaninglessness involved in coding. Here, the meaninglessness involved in coding is observed when coded data obtained on a subframe-by-subframe basis indicates the same meaning as coded data obtained on a frame-by-frame basis. The coded data obtained on a subframe-by-subframe basis usually has a greater number of bits than the coded data obtained on a frame-by-frame basis. In other words, if both of the coded data indicate the same thing, the coded data obtained on a frame-by-frame basis is preferred since it has a smaller number of bits.

Further, it may be that in the performing of the subframe processing: an identification index is coded for each of the subframes, the identification index being for identifying whether the second values are the same or different between adjacent subframes; and when all the identification indices indicate that all the second values are the same, the audio signal is coded as the exceptional processing, with at least one of the second values being a different value.

As a result, the coding efficiency can be enhanced.

Furthermore, it may be that in the exceptional processing, the audio signal is coded with the second values assumed to monotonically increase or decrease between adjacent subframes.

Moreover, it may be that each of the first and second values is a gain value used for normalizing the audio signal or a value for determining quantizing precision.

Furthermore, the audio signal decoding method of the present invention is an audio signal decoding method for decoding a coded sequence of an audio signal coded using the above audio signal coding method, the audio signal decoding method comprising identifying that the exceptional processing has been performed and decoding the coded sequence, in the case where the coded sequence has been coded in the subframe processing.

This makes it possible to appropriately decode the coded sequence, on which the coding processing including the exceptional processing has been performed.

The audio signal coding method and decoding method of the present invention can be embodied as apparatuses. In addition, the present invention can be embodied as a program that causes a computer to execute the steps of the respective methods, and as a computer-readable recording medium recorded with the program.

Effects of the Invention

The audio signal coding method and decoding method of the present invention can, not only reduce the delay, but also enhance the coding efficiency and reduce audio artifact upon coding.

BRIEF DESCRIPTION OF DRAWINGS

FIG. 6 is a diagram showing an example of a bit stream syntax.

FIG. 10 is a diagram showing an example of a conventional bit stream syntax.

FIG. 11 is a diagram showing an example of a bit stream syntax.

NUMERICAL REFERENCES

Figure 1:
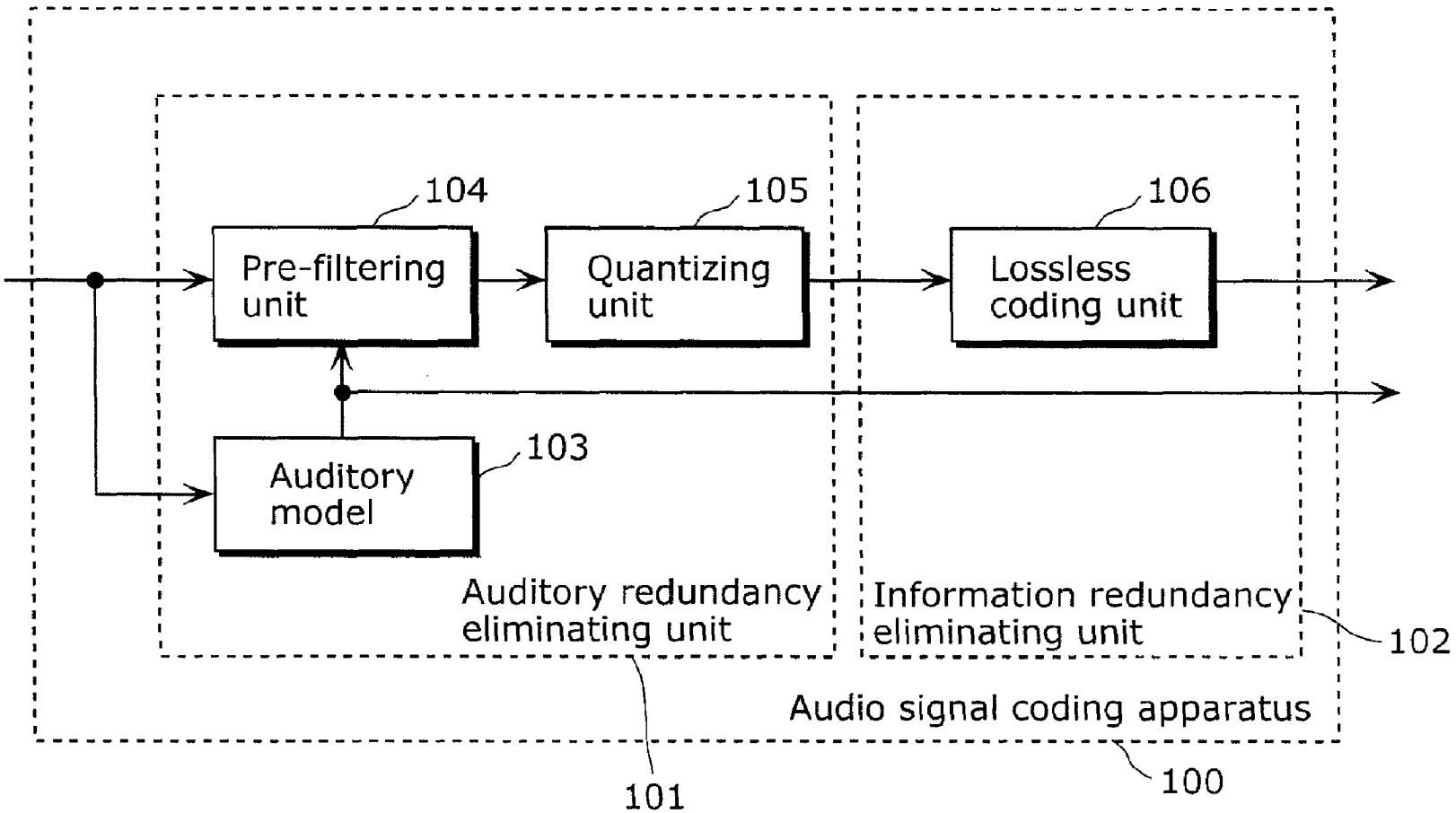
FIG. 1 is a configuration diagram of a conventional audio signal coding apparatus.

100, 300 Audio signal coding apparatus
101, 311, 321 Auditory redundancy eliminating unit
102, 312, 322 Information redundancy eliminating unit
103, 313, 323 Auditory model
104, 314, 324 Pre-filtering unit
105, 315 Quantizing unit
106, 316, 326 Lossless coding unit
200, 400 Audio signal decoding apparatus
201, 401 Lossless decoding unit
202, 402 Post-filtering unit
301 Judging unit
310 Frame processing unit
320 Subframe processing unit
325 Subframe quantizing unit
403 Gain amplifying unit

BEST MODE FOR CARRYING OUT THE INVENTION

Hereinafter, embodiments of the present invention shall be described with reference to the drawings.

Embodiment 1

An audio signal coding apparatus of the present embodiment is capable of selecting a frame coding mode for coding on a frame-by-frame basis and a subframe coding mode for coding on a subframe-by-subframe basis. Here, a subframe is a result of dividing a frame into two or more sections. Further, in the subframe coding mode, the audio signal coding apparatus codes information indicating whether gain values determined for respective subframes are of the same values or different values between temporally consecutive subframes. In the case where the determined gain values are of the same values among all the subframes, it is the same as the case where a single gain is determined for each frame. Thus, in such a case, exceptional processing different from normal processing (coding performed when gain values are deemed to be of the same values among all the subframes) is performed. It is to be noted that a gain in the present embodiment represents a ratio when a given amplitude of an audio signal is assumed to be 1, and is a value used for normalizing the audio signal.

Figure 3:
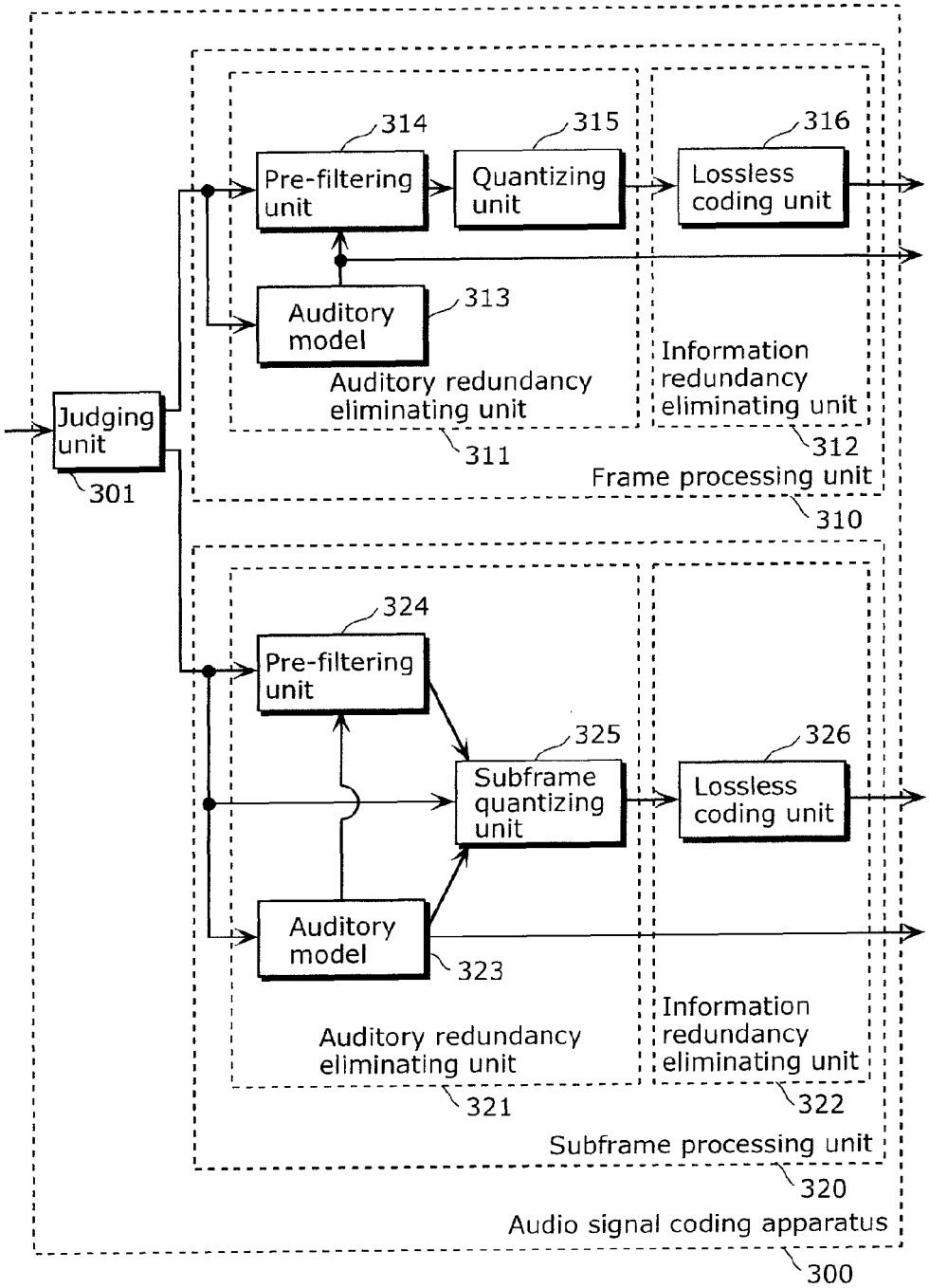
FIG. 3 is a configuration diagram of an audio signal coding apparatus of an embodiment of the present invention.

FIG. 3 is a configuration diagram of the audio signal coding apparatus according to the present embodiment.

An audio signal coding apparatus 300 in the figure includes a judging unit 301, a frame processing unit 310, and a subframe processing unit 320. The frame processing unit 310 corresponds to the conventional audio signal coding apparatus 100 shown in FIG. 1. The frame processing unit 310 includes an auditory redundancy eliminating unit 311 and an information redundancy eliminating unit 312 which correspond to the auditory redundancy eliminating unit 101 and the information redundancy eliminating unit 102 shown in FIG. 1, respectively. The auditory redundancy eliminating unit 311 includes an auditory model 313, a pre-filtering unit 314, and a quantizing unit 315 which correspond to the auditory model 103, the pre-filtering unit 104, and the quantizing unit 105 shown in FIG. 1, respectively. The information redundancy eliminating unit 312 includes a lossless coding unit 316 which corresponds to the lossless coding unit 106 shown in FIG. 1. Thus, descriptions of the same structural elements shall be omitted here, but different ones shall be described.

The judging unit 301 judges whether or not to perform coding on a subframe-by-subframe basis based on an audio signal contained in a frame so as to determine to which one of the frame processing unit 310 and the subframe processing unit 320 an audio signal sequence should be outputted.

More specifically, the judging unit 301 judges whether coding should be performed on a frame-by-frame basis (frame coding mode) or on a subframe-by-subframe basis (subframe coding mode) by detecting the maximum amplitude (energy) on a subframe-by-subframe basis for an input audio signal sequence. In the case of selecting the frame coding mode, the input audio signal sequence is outputted to the frame processing unit 310. In the case of selecting the subframe coding mode, the input audio signal sequence is outputted to the subframe processing unit 320.

The subframe processing unit 320 performs coding on the input audio signal sequence on a subframe-by-subframe basis. The subframe processing unit 320 includes an auditory redundancy eliminating unit 321 and an information redundancy eliminating unit 322. The information redundancy eliminating unit 322 and a lossless coding unit 326 included in the information redundancy eliminating unit 322 correspond to the information redundancy eliminating unit 102 and the lossless coding unit 106 shown in FIG. 1, respectively. Thus, descriptions of the information redundancy eliminating unit 322 and the lossless coding unit 326 shall be omitted here, but the information redundancy eliminating unit 321 shall be described.

The auditory redundancy eliminating unit 321 eliminates auditory redundancy on a subframe-by-subframe basis. The auditory redundancy eliminating unit 321 includes an auditory model 323, a pre-filtering unit 324, and a subframe quantizing unit 325. The auditory model 323 and the pre-filtering unit 324 have the same structures as those of the auditory model 103 and the pre-filtering unit 104 shown in FIG. 1, respectively. Thus, descriptions of the auditory model 323 and the pre-filtering unit 324 shall be omitted here, but the subframe quantizing unit 325 shall be described.

From the audio signal sequence inputted from the pre-filtering unit 324, the subframe quantizing unit 325 divides an audio signal of one frame into two or more subframes so as to perform quantization by multiplying by a gain on a subframe-by-subframe basis.

Assuming the gain as Gp and the audio signal sequence inputted into the subframe quantizing unit 325 as y(i), a relationship shown in Expression 1 can be observed for a value x(i) which is the target of the quantization.

$$y(i)=Gp\times x(i) \quad \text{(Expression 1)}$$

From the relationship shown in Expression 1, x(i) can be derived when the gain Gp is determined. Generally, x(i) is a real value, and the subframe quantizing unit 325 quantizes the real value x(i) into an integer. Then, the quantized x(i) is outputted to the lossless coding unit 326.

Figure 4:
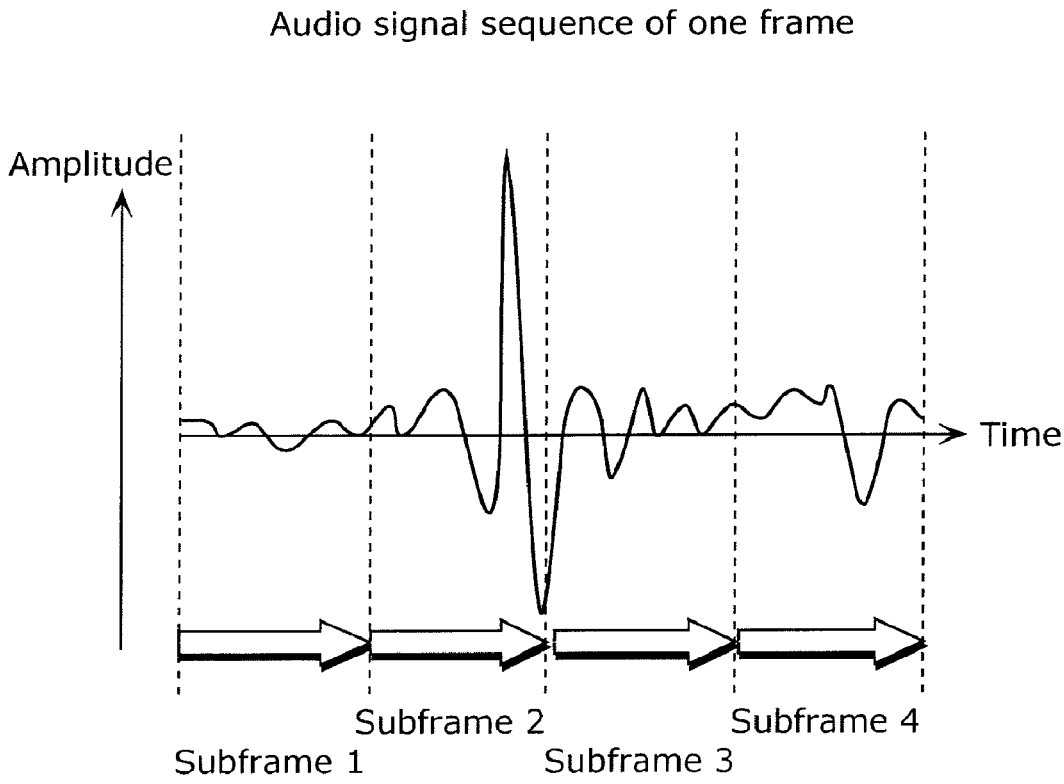
FIG. 4 is a diagram showing that an audio signal sequence of one frame inputted is divided into four subframes.

FIG. 4 is a diagram showing that an audio signal sequence of one frame inputted is divided into four subframes. In FIG. 4, the horizontal axis represents time and the vertical axis represents amplitude of the audio signal. The number of samples in one frame is assumed to be, but not limited to, 128 as an example. Shown here is a case where an audio signal sequence of one frame is divided into four subframes uniformly, each having 32 samples. It is to be noted that in the present invention, a different number of subframes may be used and the lengths of the subframes may not be uniform.

In the case of FIG. 4, the amplitudes of the subframes 2 and 3 are greater than those of the subframes 1 and 4. Therefore, in the case of uniformly quantizing all the subframes into integers, if a gain value is taken which reduces the amplitude values of the subframes 2 and 3, the amplitude value of 0 may frequently appear in the subframes 1 and 4, which could cause audio artifact. Further, if a gain value is taken which ensures the amplitude values of the subframes 1 and 4, the values of the subframes 2 and 3 become larger, which deteriorates the coding efficiency, and could raise the bit rate as a result.

In view of the above, in the case of FIG. 4, the subframe quantization (a gain value to be set) for the subframes 2 and 3 should be changed for the subframes 1 and 4, since that way the audio artifact could be suppressed and the coding efficiency could be enhanced to a greater extent.

In order to implement coding that suppresses audio artifact and enhances the coding efficiency, the subframe quantizing unit 325 may refer to some of or all of the following as shown in FIG. 3: an audio signal sequence corresponding to an inputted original sound; an output result from the pre-filtering unit 324; and an output of the auditory model 323. For example, regardless of the amplitude values of the audio signal sequence inputted from the pre-filtering unit 324, a gain that is large enough for improving the audio quality may be determined for a subframe having a small amplitude appearing before a large amplitude, based on the amplitude values of the original sound.

Figure 5:
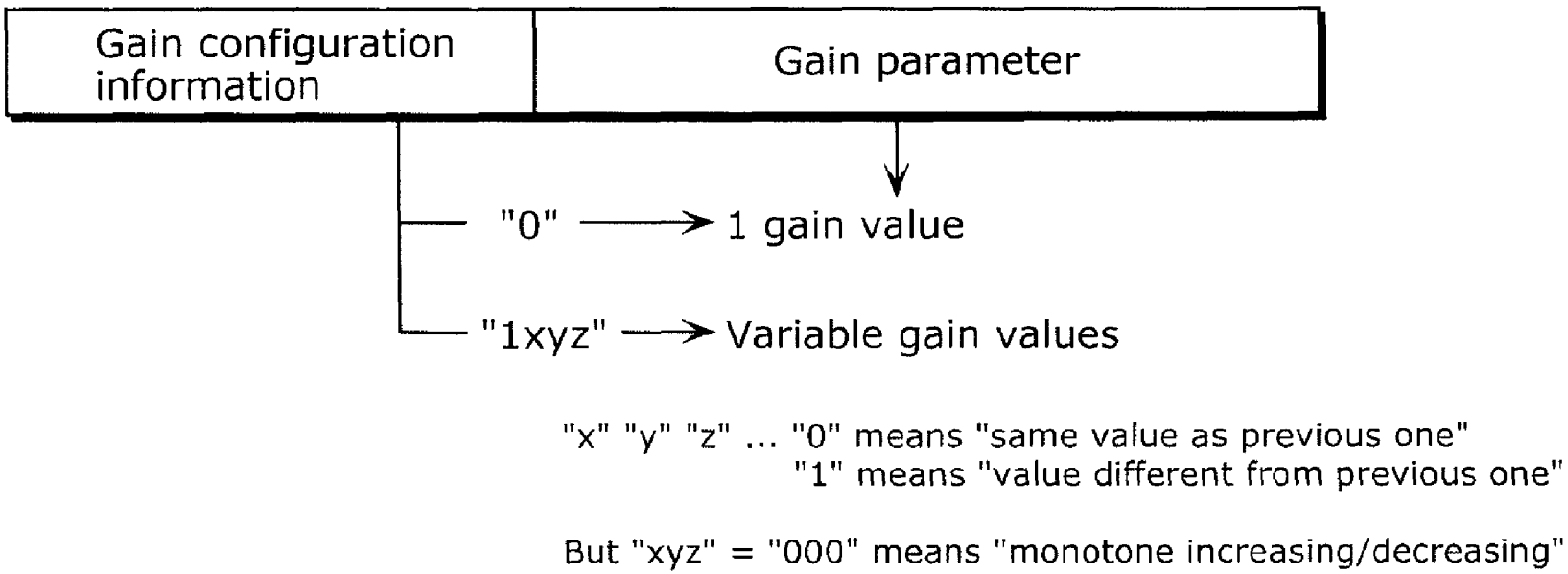
FIG. 5 is a diagram showing an example of a coded stream structure.

FIG. 5 is a diagram showing an example of a coded stream structure.

The first part of the stream which stores gain information shows gain configuration information indicating how a gain is stored. In the example shown in the figure, when the value is "0", it means that only one gain value is assigned to the plural subframes. When the value is "1", it means that two or more gain values are assigned to plural subframes. The settings for the gain configuration information are made by the judging unit 301. The judging unit 301 selects whether to use a gain value common to the subframes (set the value to "0") or a gain value different for each subframe (set the value to "1") for an input audio signal of one frame.

That is to say, the initial value of the gain configuration information being "0" means that the frame coding mode is to be executed. On the other hand, the initial value of the gain configuration information being "1" means that the subframe coding mode is to be executed.

When the initial value of the gain configuration information is "1", three values are stored following the value "1", namely, "x", "y" and "z" as shown in FIG. 5, given that the number of subframes is four because 3 is 4 minus 1. The values "x", "y" and "z" each represent a correlation between subframes. Obviously, the number of subframes is not limited to four. The value "x" takes "0" when the gain value of the subframe 1 is the same as that of the subframe 2. It takes "1" when the gain value of the subframe 1 is different from that of the subframe 2. The value "y" takes "0" when the gain value of the subframe 2 is the same as that of the subframe 3. It takes "1" when the gain value of the subframe 2 is different from that of the subframe 3. The value "z" takes "0" when the gain value of the subframe 3 is the same as that of the subframe 4. It takes "1" when the gain value of the subframe 3 is different from that of the subframe 4. The subframe quantizing unit 325 sets the values that represent the correlations between the subframes and that follow the initial value of the gain configuration information when the initial value is "1". Obviously, "0" and "1" may indicate the opposite meaning. In other words, "0" may indicate that the gain values are different between temporally consecutive subframes, whereas "1" may indicate that the gain values are the same between temporally consecutive subframes.

In such a manner as above, the gain configuration information is set. When the gain configuration information indicates "0", there is only one gain parameter in total. When the gain configuration information is a sequence of "1010", for example, there are two gain parameters. In more detail, the gain value of the subframe 1 is the same as that of the subframe 2, the gain value of the subframe 2 is different from that of the subframe 3, and the gain value of the subframe 3 is the same as that of the subframe 4.

There may be an unusual case where the gain configuration information is a sequence of "1000". In such a case, exceptional processing different from the normal processing is executed. The reason for providing the exceptional processing is as follows:

When the gain configuration information is a sequence of "1000", taking into account the ordinary meaning described above, it defines that there are two or more gain values, yet all the gain values are the same among the subframes 1 through 4. That is to say, the gain configuration information being "0" and a sequence of "1000" means that a single gain is used for a given one frame (all subframes). Thus, at least three bits become wasteful for indicating the same information. As described, even when the judging unit 301 selects the subframe coding mode and performs processing on a subframe-by-subframe basis, the result of the processing outputted becomes the same as the result of the processing performed in the frame coding mode. In that case, the coding efficiency deteriorates as a consequence.

As the exceptional processing different from the normal processing, the gains of the subframes are defined to monotonically increase (or monotonically decrease), for example.

In the coded stream, a value g1 comes first, and a value delta_gx the next as the coding sequence which follows the gain configuration information for deriving the actual gains of the subframes. The value g1 can be obtained by coding a gain derived using the maximum amplitude, for example, of an audio signal contained in the subframe 1. The value delta_gx can be obtained by coding a difference between a gain of a subframe x−1 and a gain of a subframe x. The variable x is an integer equal to or greater than two, and the maximum value of x equals the number of subframes (four in FIG. 5).

By performing after-mentioned decoding processing on the values g1 and delta_gx, G1 and delta_Gx are derived, respectively. G1 is a value indicating the gain of the subframe 1. Delta_Gx is a value indicating a difference between a gain of a subframe x−1 and a gain of a subframe x.

When there is one gain value for one frame, the coded value g1 alone follows the gain configuration information in the coding processing. In the decoding processing, the gain G1 is derived from the value g1, and G1=G2=G3=G4 is applied. When there are two or more different gain values for one frame, values delta_g2, delta_g3, and delta_g4 follow the value g1 in the coding processing. In the decoding processing, the gain G1 is first derived from the value g1. Then, using delta_G2 which is a value derived by decoding delta_g2, G2=G1+delta_G2 is calculated. Thereafter, delta_g3 and delta_g4 are decoded to calculate the gains G3 and G4 sequentially.

FIG. 6 shows an example of a bit stream syntax which is the detail of the example of the coded stream structure shown in FIG. 5. What is written on the "syntax" side is an example of a bit stream syntax, and the "number of bits" shows an example of the number of bits used then. What is written in italics and boldface is to be coded as a bit stream. What is written in italics but not in boldface is a variable which, when read as a bit stream once, holds the value of the bit stream. NumGainBits, numMonoDeltaBits, and numDeltaBits written in the number of bits are assigned with an integer when implemented.

In FIG. 6, bs_multi_gain is flag information for identifying whether there is a single gain or the gain includes two or more different values for plural subframes. That is to say, it indicates the initial value of the gain configuration information of FIG. 5. For example, when bs_multi_gain is 0, it means that there is a single gain as in FIG. 5. When bs_multi_gain is 1, it means that the gain includes two or more different values for plural subframes.

Bs_same_gain[num] is flag information for identifying whether or not the gain of the num-1$^{th}$ subframe (hereinafter referred to as num-1 subframe) and the gain of the num$^{th}$ subframe (hereinafter referred to as num subframe) are the same. That is to say, it indicates "x", "y" and "z" of the gain configuration information of FIG. 5. For example, when bs_same_gain[num] is 0, it means that the gain of the num-1 subframe and that of the num subframe are the same. When bs_same_gain[num] is 1, it means that the gains have different values.

Bs_gain[0] is a value used for deriving a gain. When there is a single gain (bs_multi_gain is 0), the gain value derived using bs_gain[0] is the gain value of all of the subframes. When a gain includes two or more different values for plural subframes (bs_multi_gain is 1), the gain value derived using bs_gain[0] is the gain value of the initial subframe.

With frames for which bs_same_gain[num] is 0, the value for deriving the difference between a gain of the num-1 subframe and that of the num subframe (or deriving the gain of the num subframe) is coded as bs_delta[num], in the order starting from the frame with the smallest num.

The syntax shown in FIG. 6 describes the exceptional processing to be performed, in case of bs_same_gain[num] being all 0. Here, as the exceptional processing, the gain monotonically increases. Therefore, the value for deriving the difference between a subframe and an immediately preceding subframe is coded as bs_mono_delta. In other words, bs_mono_delta is a value for deriving a rate of increase in monotone increase. Thus, the amount increased in monotone increase may be directly coded, or indirectly derived from a table, for example.

Next, operations of the audio signal coding apparatus according to the present embodiment shall be described.

Figure 7:
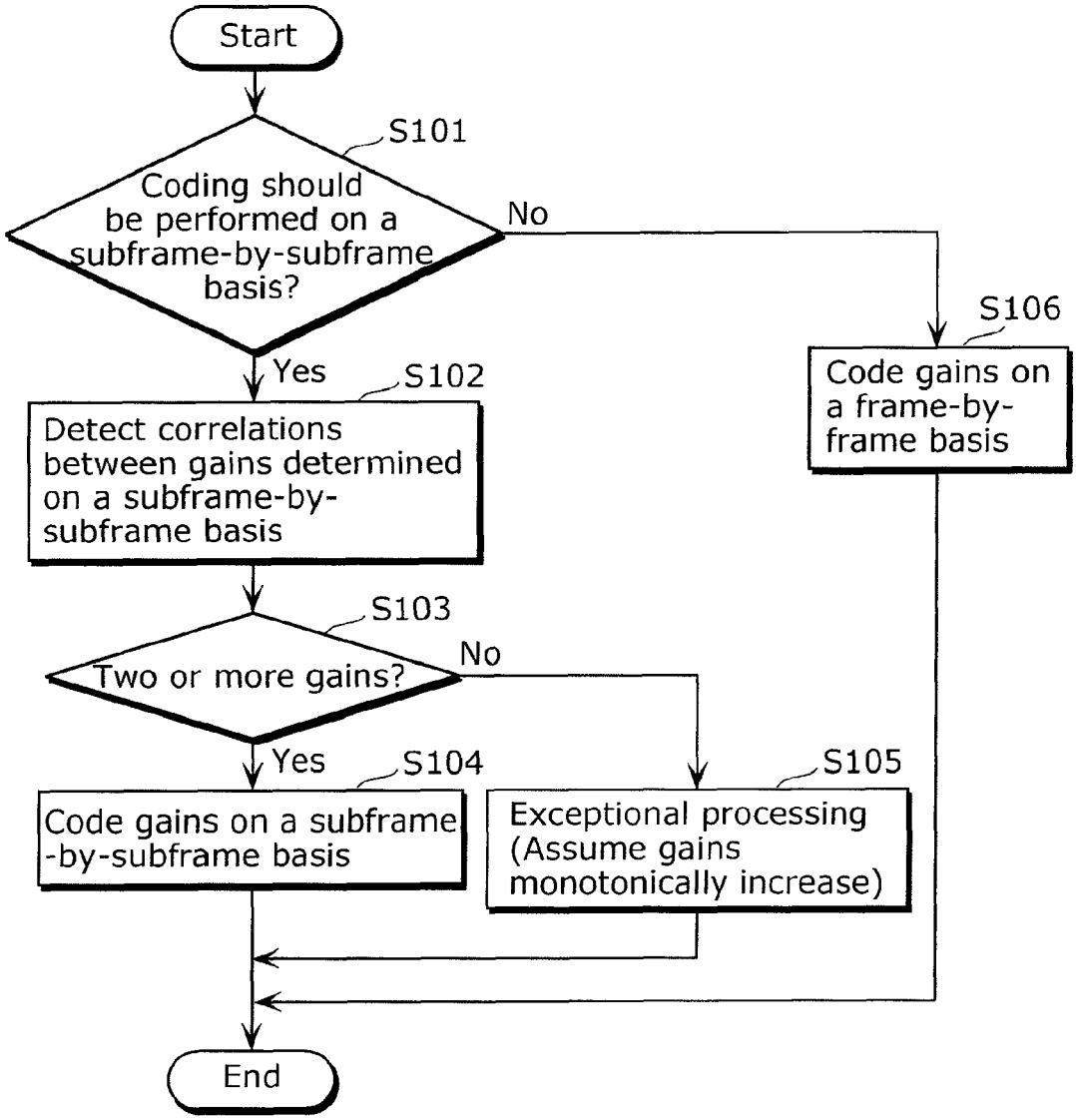
FIG. 7 is a flowchart showing operations of an audio signal coding apparatus of an embodiment of the present invention.

FIG. 7 is a flowchart showing the operations of the audio signal coding apparatus of the present embodiment.

Upon receiving an audio signal sequence, the judging unit 301 selects either the frame coding mode or the subframe coding mode (S101). That is to say, bs_multi_gain of FIG. 6 is determined. In the case of selecting the frame coding mode (No in S101), the audio signal sequence is outputted to the frame processing unit 310. In this case, the frame processing unit 310 sets bs_multi_gain to 0. In the case of selecting the subframe coding mode (Yes in S101), the audio signal sequence is outputted to the subframe processing unit 320. In this case, the subframe processing unit 320 sets bs_multi_gain to 1.

More specifically, the judging unit 301 detects the fluctuations in the audio signal sequence by using the maximum amplitude of the audio signal sequence. When the audio signal has almost no fluctuations, e.g. when the maximum amplitude is no greater than a threshold, the quantization and coding should be performed on a frame-by-frame basis. Therefore, the audio signal sequence is outputted to the frame processing unit 310. On the other hand, when the maximum amplitude is greater than the threshold, the quantization and coding should be performed on a subframe-by-subframe basis. Therefore, the audio signal sequence is outputted to the subframe processing unit 320. The example of the audio signal sequence shown in FIG. 4 has great fluctuations, and is therefore outputted to the subframe processing unit 320 to be quantized and coded on a subframe-by-subframe basis.

In the case of selecting the subframe coding mode (Yes in S101), the subframe quantizing unit 325 determines gains on a subframe-by-subframe basis and detects correlations between the determined gains (S102). In more detail, the subframe quantizing unit 325 detects whether the gain values determined on a subframe-by-subframe basis are of the same values or different values. In other words, it detects the values corresponding to "x", "y" and "z" of FIG. 5.

Next, the detected correlations (subframe-by-subframe based gain values) are judged (S103). When the determined gains are of two or more different values for plural subframes (Yes in S103), gains are derived on a subframe-by-subframe basis (S104).

In more detail, the difference between each of the gain values determined on a subframe-by-subframe basis and the gain value of the previous subframe is calculated.

When the determined gains are of the same values for all of the subframes (No in S103), exceptional processing is performed (5105). Here, as an example of the exceptional processing, the determined gains are assumed to monotonically increase (or monotonically decrease).

Figure 8:
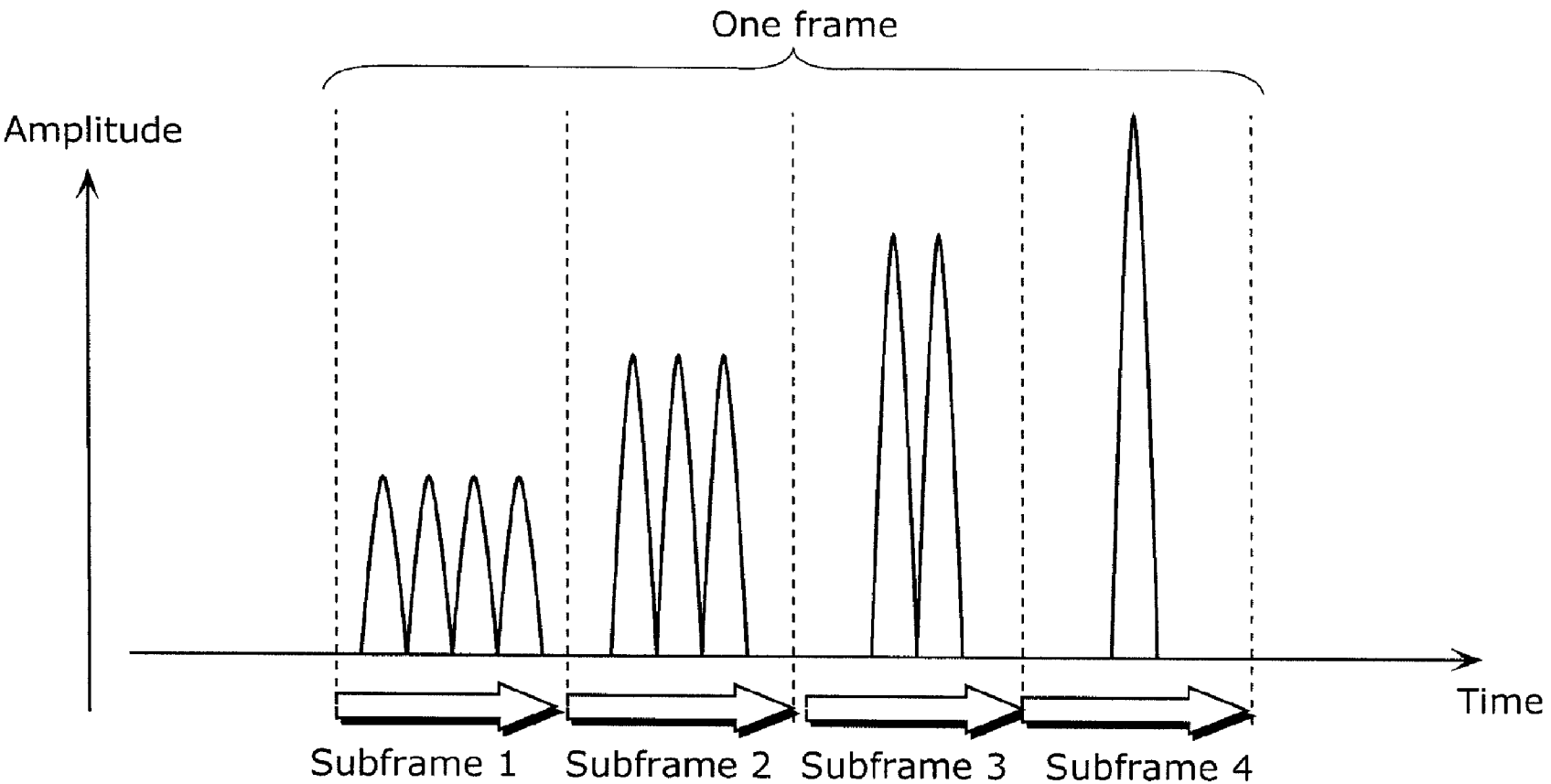
FIG. 8 is a diagram showing an example of an audio signal sequence which may undergo exceptional processing.

FIG. 8 is a diagram showing an example of an audio signal sequence on which exceptional processing may be performed. Such an audio signal sequence arises when, for example, a sound close to noise fades into a musical tone.

When the audio signal sequence shown in the figure is inputted, the judging unit 301 judges that the fluctuations in the audio signal are great by using the maximum amplitude of each subframe. Therefore, it selects the subframe coding mode. Here, the subframe quantizing unit 325 is assumed to determine a gain value based on the energy level of an audio signal sequence contained in a subframe. In the example shown in FIG. 8, the energy levels of the subframes 1 to 4 are almost equal. Therefore, the gain values for all of the subframes are of a single, equal value. Thus, the gain configuration information becomes a sequence of "1000".

It should be noted that when the judging unit 301 selects the frame coding mode for the audio signal sequence of FIG. 8, the subframes 1 to 4 are judged as one frame, and thus a single gain value is determined. As a consequence, even though the subframe coding mode is selected, the same result as that in the case of selecting the frame coding mode is outputted. To put it differently, selecting the subframe coding mode becomes meaningless.

In order to prevent the selection of the subframe coding mode becoming meaningless as above, when the gain configuration information is a sequence of "1000", quantization and coding are performed on the gains on a subframe-by-subframe basis, assuming that the gains monotonically increase as exceptional processing.

When the frame coding mode is selected (No in S101) in the selection processing (S101), one gain is determined for each frame, and the determined gain is quantized and coded (5106).

When the above processing (S101 to S106) is finished for one frame, the same processing is repeated for the next frame.

As above, the exceptional processing is performed in the case where, even when the subframe coding mode is selected, the same result as that of selecting the frame coding mode is obtained. By doing so, it is possible to prevent processing becoming meaningless.

Now, a conventional bit stream syntax is illustrated to clarify the difference from the present embodiment.

FIG. 10 is an example of a conventional bit stream syntax, and this syntax is included in a module called groupings according to the AAC scheme. In the syntax, when window_sequence comes to have the same value as EIGHT_SHORT_SEQUENCE, eight MDCT (Modified Discrete Cosine Transform) coefficient sequences are divided into some groups. How the groups are formed is indicated by scale_factor_grouping (seven bits) which is a bit stream variable. In more detail, information is coded in seven bits in total which indicates, by one bit each, whether or not each of eight MDCT coefficient sequences forms a group with an immediately previous MDCT coefficient sequence. It is simply defined that when the information indicates in all bits that each MDCT coefficient sequence forms the same group with the immediately previous MDCT coefficient sequence, the eight MDCT coefficient sequences are seen as one group to be coded and decoded. In other words, the processing does not move on to different processing such as monotone increase of the gains. Unlike the present embodiment, when meaninglessness occurs as a result, exceptional processing for preventing such occurrence is not performed.

Next, an apparatus utilizing the audio signal decoding method of the present embodiment shall be described.

Figure 2:
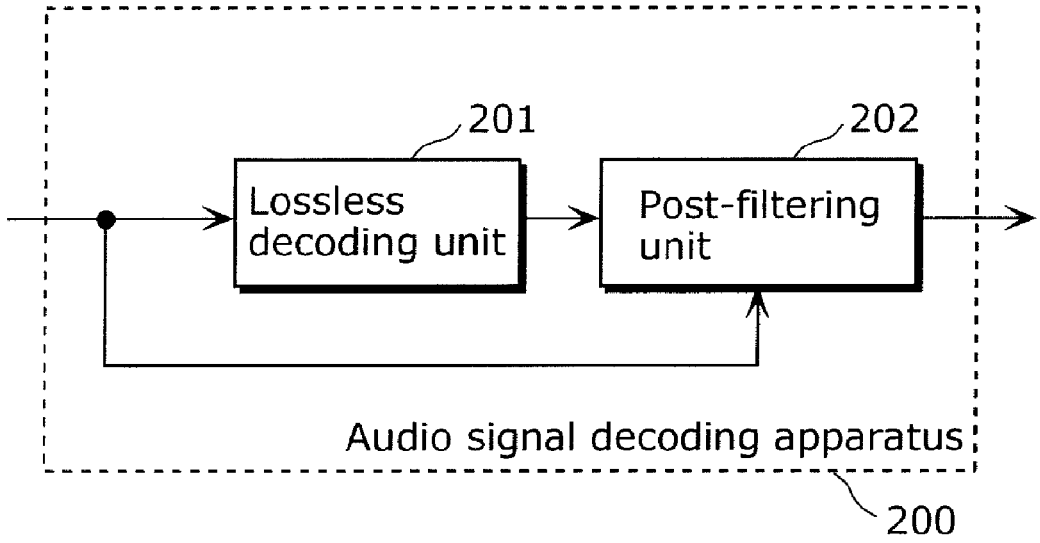
FIG. 2 is a configuration diagram of a conventional audio signal decoding apparatus.
Figure 9:
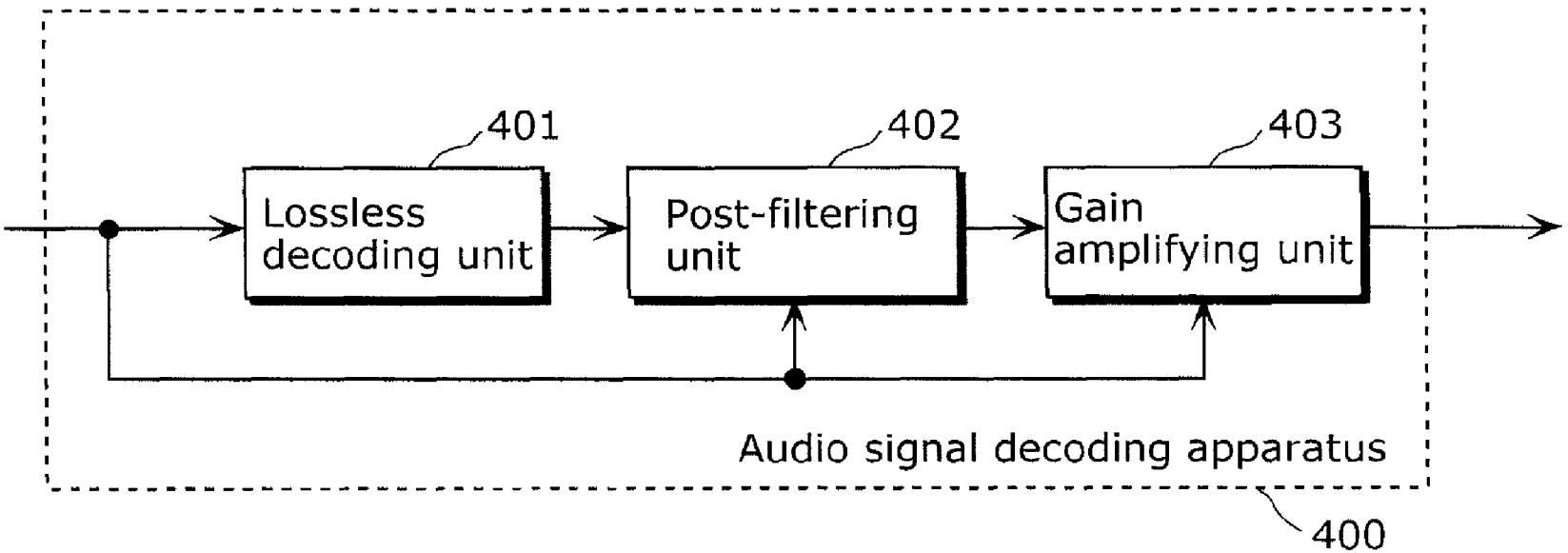
FIG. 9 is a configuration diagram of an audio signal decoding apparatus of an embodiment of the present invention.

FIG. 9 is a configuration diagram of an audio signal decoding apparatus of the present embodiment. An audio signal decoding apparatus 400 in the figure decodes an audio signal which has been coded. The audio signal decoding apparatus 400 includes a lossless decoding unit 401, a post-filtering unit 402, and a gain amplifying unit 403. The lossless decoding unit 401 and the post-filtering unit 402 correspond to the lossless decoding unit 201 and the post-filtering unit 202 shown in FIG. 2, respectively. Therefore, descriptions of the lossless decoding unit 401 and the post-filtering unit 402 shall be omitted here, but the gain amplifying unit 403 shall be described.

For the audio signal received from the post-filtering unit 402, the gain amplifying unit 403 amplifies a decoded audio signal on a subframe-by-subframe basis.

As stated above, the audio signal coding method and decoding method of the present embodiment can achieve efficient use through exceptional processing performed for a coding step which may become meaningless when coding is performed. As a result, while maintaining the benefit of the low-delay processing, it is possible to suppress audio artifact and achieve highly efficient coding.

Although the audio signal coding method and decoding method of the present embodiment have been described above, it is obvious that the present invention is not limited to the above embodiment, and many modifications are possible which are intended to be included within the scope of the present invention.

For example, as shown in FIG. 11, when the gains of subframes are assumed to monotonically increase, the number of subframes having a gain that monotonically increases may be coded as exceptional processing.

FIG. 11 shows an example of a bit stream syntax different from that of FIG. 6, and shows in more detail the coded stream structure of FIG. 5. What is written on the "syntax" side is an example of a bit stream syntax, and the "number of bits" shows an example of the number of bits used then. What is written in italics and boldface in the syntax is to be coded as a bit stream. What is written in italics but not in boldface is a variable which, when read as a bit stream once, holds the value of the bit stream. NumGainBits, numSubFrBits, numMonoDeltaBits, and numDeltaBits written in the number of bits are assigned with an integer when implemented.

In FIG. 11, bs_multi_gain, bs_same_gain[num] and bs_gain[0] are the same as bs_multi_gain, bs_same_gain [num] and bs_gain[0] in FIG. 6. Thus, descriptions thereof shall be omitted.

In FIG. 11, as in FIG. 6, when bs_same_gain[num] are all 0, it means monotone increase. Bs_num_cont is a value for deriving the number of subframes having a gain that monotonically increases. As for the subframes having a gain that monotonically increases, the value for deriving the difference between a subframe and an immediately preceding subframe is coded as bs_mono_delta. For example, when the total number of subframes is eight, and bs_num_cont derives that three of them have a gain that monotonically increases, the gain monotonically increases by the difference values derived with the bs_mono_delta between the subframes 1 and 2, between the subframes 2 and 3, and between the subframes 3 and 4. The subsequent subframes, namely, subframes 5 to 8, are assumed to take the same value as that of the subframe 4, for example.

On the other hand, as for frames for which bs_same_gain [num] is 0, the value for deriving the difference between the gain of a num-1 subframe and that of a num subframe (or deriving the gain of the num subframe) is coded as bs_delta [num], in the order starting from the frame with the smallest num.

As described above, the bit stream syntax of FIG. 11 makes it possible to code the number of subframes having a gain that monotonically increases, in the case where exceptional processing is performed. As a result, the coding efficiency can be enhanced.

Furthermore, although in the present embodiment the judging unit 301 selects the frame coding mode and the subframe coding mode by using the maximum amplitude of an audio signal, the energy level of the audio signal may be used instead of the maximum amplitude.

Figure 12:
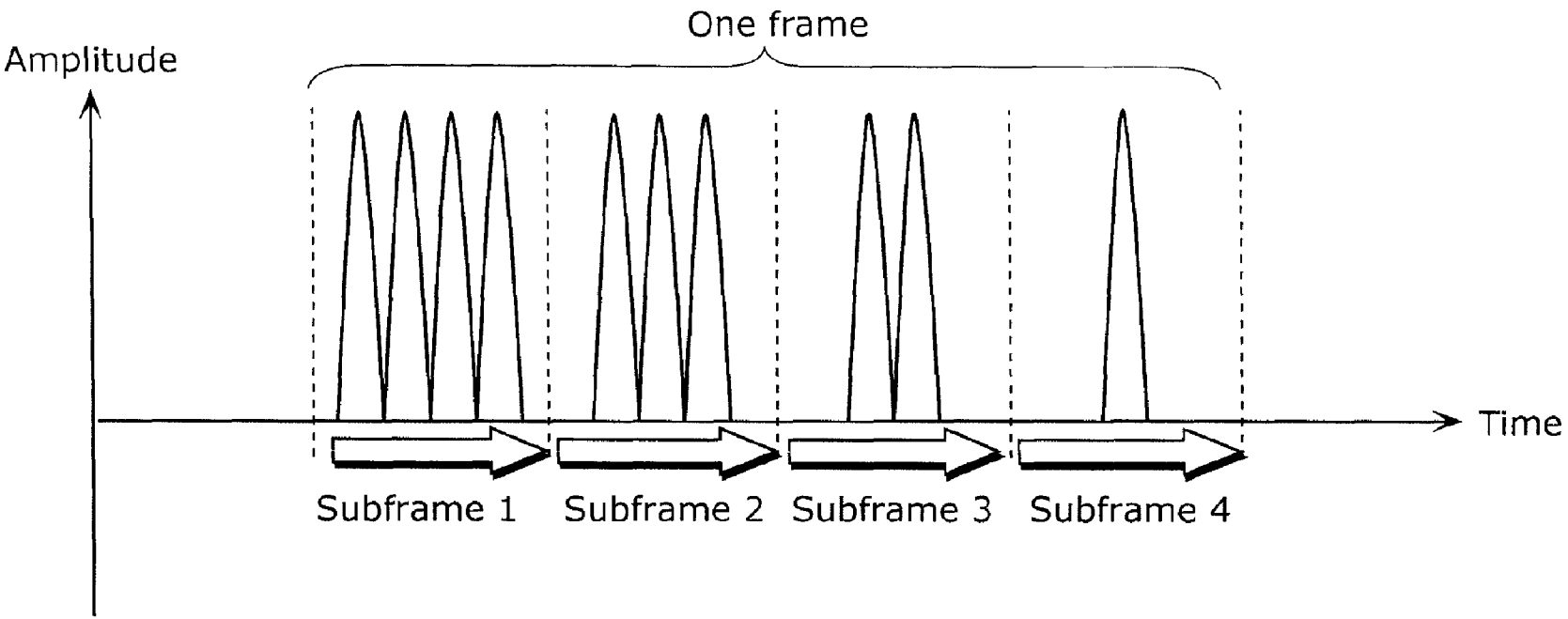
FIG. 12 is a diagram showing an example of an audio signal sequence which may undergo exceptional processing.

Even in this case, exceptional processing needs to be performed when an audio signal sequence as shown in FIG. 12 is inputted. FIG. 12 is a diagram showing an example of an audio signal sequence on which exceptional processing may be performed, and it shows, as an example, an audio signal sequence in the case of a sound source produced by an stringed instrument or a percussion instrument. In the case of an stringed instrument or a percussion instrument, the intensity (maximum amplitude) of each sound is uniform, but the number of sounds contained in a subframe is different. Accordingly, an audio signal sequence as shown in FIG. 12 is obtained.

The judging unit 301 selects the subframe coding mode since the fluctuations of the energy level of each subframe are great as shown in FIG. 12. Here, the subframe quantizing unit 325 is assumed to determine a gain value based on the maximum amplitude of an audio signal sequence contained in a subframe. In the example shown in FIG. 12, the maximum amplitudes of the subframes 1 to 4 are almost equal. Therefore, the gain values for all of the subframes are of a single, equal value. Thus, the gain configuration information becomes a sequence of "1000". As a result, as in the case of FIG. 8, the subframe quantizing unit 325 performs exceptional processing.

Even when the judging unit 301 selects the subframe coding mode based on the energy level, there may be a case where the bit rate cannot be raised due to a restriction. In that case, as a consequence, the one consuming a small number of bits needs to be selected for each subframe, and the same coding processing is selected for every subframe. In this case too, the gain configuration information becomes a sequence of "1000". As a result, as in the cases of FIGS. 8 and 12, the subframe quantizing unit 325 performs exceptional processing.

Figure 13:
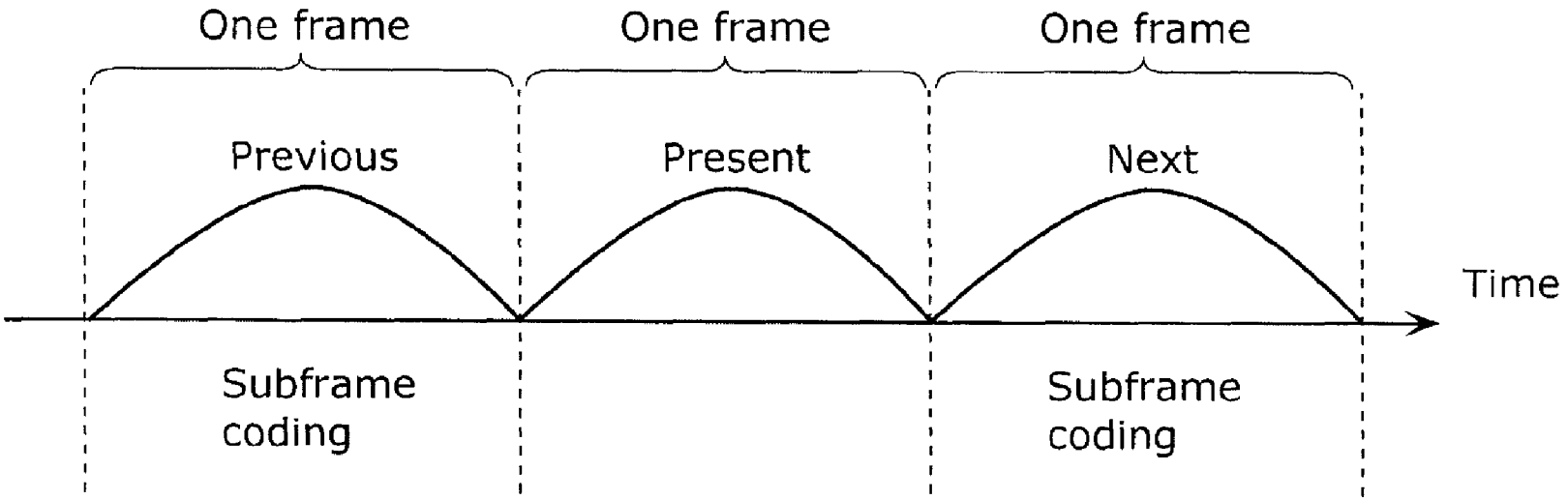
FIG. 13 is a diagram showing an example of an audio signal sequence which may undergo exceptional processing.

Further, as shown in FIG. 13, with the schemes such as AAC, in the case where frames that are temporally out of sequence are coded in the subframe coding mode, the subframe coding needs to be selected even for a current frame according to coding regulations in order to ensure the continuity of the frames. Therefore, given that the audio signal sequence of the current frame has almost no fluctuations, the gain configuration information becomes a sequence of "1000". As a consequence, the subframe quantizing unit 325 performs exceptional processing.

In addition, in the present embodiment, to derive gain values, gain values may be defined in a table and the like provided in advance. In this case, there may be an instance where decoding is performed using a method such as G1=table (g1). In that instance, there may be a case where decoding is performed through G2=table (g1+g2) or G2=table(g1)+table2(g2), for example.

When the gain configuration information defines monotone increase (monotone decrease), the values of G2 through G4 are decoded through Gp=Gp−1+delta Gp, Gp=table (gp−1+gp), or Gp=table(gp−1)+tablep(gp), for example. Here, p is an integer no less than 2.

Furthermore, differential coding is employed for coding two or more gains, but instead of using differential information, a value may be used which allows, for gains following a first gain, direct decoding of values of the corresponding subframes without using the value of a previous subframe.

Moreover, the audio signal coding apparatus 300 in the present embodiment includes, as shown in FIG. 3, the frame processing unit 310 and the subframe processing unit 320 in order to clearly distinguish between the frame-by-frame-based processing and the subframe-by-subframe-based processing. However, it may be that the auditory model 313 and the auditory model 323 share a common unit, the pre-filtering unit 314 and the pre-filtering unit 324 share a common unit, and the lossless coding unit 316 and the lossless coding unit 326 share a common unit.

Embodiment 2

According to an audio signal coding method and decoding method of the present embodiment, coding and decoding are performed on quantizing precision information which affects the coding efficiency upon lossless-coding. That is to say, what is different from Embodiment 1 is the target for coding and decoding being quantizing precision information instead of gains. In the present embodiment, descriptions of the same aspects as that of Embodiment 1 shall be omitted here, but different ones shall be described.

As in Embodiment 1, the apparatus which implements the audio signal coding method of the present embodiment is the audio signal coding apparatus shown in FIG. 3.

In the present embodiment, the subframe quantizing unit 325 quantizes the quantizing precision information. For example, considering audibility, quantizing precision information Rp is set to a small value for an audio signal of an important sample, in order to ensure adequate quantizing precision.

Assuming an audio signal inputted into the subframe quantizing unit 325 as y(i) and the quantizing precision information as Rp, a relationship shown in Expression 2 can be observed for z(i) which is the target of the quantization.

$$y(i)=Rp\times z(i) \quad \text{(Expression 2)}$$

From the relationship shown in Expression 2, z(i) can be derived when the quantizing precision information Rp is determined. Generally, z(i) is a real value, and thus the subframe quantizing unit 325 quantizes the real value z(i) into an integer. Then, the quantized z(i) is outputted to the lossless coding unit 326.

As apparent from a comparison between Expression 1 illustrated in Embodiment 1 and Expression 2, the gain Gp is simply replaced with quantizing precision information Rp, and x(i) with z(i) accordingly. No change is made to the modules other than these, such as the lossless coding unit 326 and the auditory model 323.

As described above, the audio signal coding method and decoding method of the present embodiment can suppress audio artifact and make the absolute value of z(i) larger by, considering audibility, setting the quantizing precision information Rp to a small value for an audio signal of an important sample. This makes it possible to reduce the adverse effect of quantization errors that occur in the quantization process of converting a real value into an integer.

Embodiment 3

An audio signal coding method and decoding method of the present embodiment can be applied to an audio signal coding method and decoding method in which time-frequency transformation is performed. This is the difference from Embodiments 1 and 2, since in the coding method and decoding method of Embodiments 1 and 2, time-frequency transformation is basically not performed, that is, they are time-domain coding method and decoding method.

A first application is to a system using batch orthogonal transformation in which more than one transformation lengths are used, typified by the MPEG2-AAC.

In this system, a frame is formed for every given set of samples from an input audio signal, and the samples in the frame undergo batch orthogonal transformation so that a frequency spectral sequence is generated and then the frequency spectrum sequence is quantized and coded. It is selected whether to perform a single batch orthogonal transformation per frame or temporally-consecutive plural batch orthogonal transformations per frame.

When temporally-consecutive plural batch orthogonal transformations are performed per frame to obtain a frequency spectral sequence from each batch orthogonal transformation, the coding method of Embodiment 1 is applied to a representative gain of each frequency spectral sequence, so that the coding efficiency can be enhanced.

A second application is to a system using batch orthogonal transformation in which a single transformation length is used, typified by the Low Delay AAC.

In this system, a frame is formed for every given set of samples from an input audio signal, and the samples in the frame undergo batch orthogonal transformation so that a frequency spectral sequence is generated and the frequency spectrum sequence is quantized and coded. A single orthogonal transformation is performed per frame.

Thus, since the orthogonal transformation is performed only once per frame, it is impossible to obtain temporal fluctuations in a frame. In that case, to obtain information on temporal fluctuations, plural, temporal subframes are formed separately in advance regardless of the orthogonal transformation, and the subframes are used for quantizing and coding the temporal gain information. In the decoding processing, the plural subframes may be used when, for example, an audio signal of a frame decoded in batch orthogonal transformation is corrected using the temporal gain information.

The coding efficiency can be enhanced also by dividing a frequency spectral sequence, which is obtained from a single orthogonal transformation, into plural sub bands on the frequency axis (corresponding to subframes on the time axis), and then applying the coding method of Embodiment 1 to a representative gain of each sub band.

A third application is to a system using polyphase filtering for forming a time-frequency matrix, typified by the QMF (Quadrature Mirror Filter).

Obtained in this system is a time signal sequence containing plural samples in plural frequency sub bands. Thus, the coding method of Embodiment 1 may be applied to the gains of the signals of the plural frequency sub bands in given time samples. Further, a frequency sub band may be selected, and then, the coding method of Embodiment 1 may be applied to a representative gain of time signal sequences which contain plural samples of the selected frequency sub band and which are classified into groups in units of one or more time signal sequences.

A fourth application is to a system using, in addition to the polyphase filtering of the third application, batch orthogonal transformation typified by DCT, as additional processing.

In this system, output of the polyphase filtering is the same as that in the third application, but when frequency intervals of sub bands are long, for example, there occurs a deficiency in the frequency resolution of low frequency components in particular. So, to improve the frequency resolution of low frequency components, time-frequency transformation is performed using, for example, orthogonal transformation such as Discrete Cosine Transform (DCT), on a time signal sequence which is included in the output of the polyphase filtering and which corresponds to the low frequency components.

The fourth application can be implemented as a combination of the second and third applications. For example, the same technique as that of the second application may be used in low frequency components, whereas the technique of the third application may be used in high frequency components to achieve the same enhancement of the coding efficiency.

As described, even in the various systems utilizing the time-frequency transformation included in the audio signal coding method and decoding method, the coding efficiency can be enhanced by basically using the coding method and decoding method similar to the ones in Embodiment 1. Although the coding of gains has been described above, even when the coding method and decoding method similar to the ones in Embodiment 2 are performed with quantizing precision in place of the gains, the coding efficiency can still be expected to improve in the same manner.

As described, the audio signal coding method and decoding method of the present embodiment are applicable in the case where the target for coding is divided into some groups (e.g. frames on the time axis and bands on the frequency axis) and then coding is performed on a group-by-group basis. They are also applicable in the case where one group is divided into plural sub groups (e.g. subframes on the time axis and sub bands on the frequency axis) and then coding is performed on a sub group-by-sub group basis.

Although the audio signal coding method and decoding method of the present invention have been described above with some exemplary embodiments, the present invention is not to be limited to these embodiments. Those skilled in the art will readily appreciate that many modifications are possible in the exemplary embodiments without materially departing from the novel teachings and advantages of this invention. Accordingly, all such modifications are intended to be included within the scope of this invention For example, in the present embodiment, performed as exceptional processing is processing in which gain values, for example, are assumed to monotonically increase or decrease. However, it may be any other processing as long as it is different from the normal processing. For example, it may be processing in which gain values, for example, are assumed to take a large value and a small value alternately on a subframe-by-subframe basis. Further, it may be processing in which gain values, for example, are assumed to vary between subframes in accordance with a predetermined rule.

Furthermore, although in the present embodiment values for determining gain values or quantizing precision are quantized and coded, the target of the quantization and coding is not limited to such values. The quantization and coding may be performed on other values related to the coding of audio signals.

The present invention may be embodied as: a program that causes a computer to execute the steps of the audio signal coding method and decoding method of the present invention; a computer-readable recording medium, such as a CD-ROM, recorded with the program; and information, data or signal that indicates the program. Such a program, information, data, or a signal may be distributed via a communication network such as the Internet.

INDUSTRIAL APPLICABILITY

The audio signal coding method and decoding method of the present invention are applicable to various applications to which conventional audio coding methods and decoding methods have been applied. Application is possible particularly when, for example, broadcast contents are transmitted, recorded on a storing medium such as DVDs and SD cards and played back, and when AV contents are transmitted to a communication appliance typified by mobile phones. Further, it is also useful when audio signals are transmitted as electronic data exchanged over the Internet.

The invention claimed is:

1. An audio signal coding method for coding an audio signal to be coded, said method comprising:

judging, using a judging unit, for each of frames whether or not coding should be performed on each of two or more subframes into which the frame is divided, based on an audio signal contained in the frame into which the audio signal to be coded is divided for every set of samples; and when judged that the coding should be performed on each of the subframes, performing, using a subframe processing unit, for each subframe, subframe processing of (i) determining a value representing a characteristic of an audio signal of the subframe, and (ii) coding the audio signal using the determined value, wherein in said performing of the subframe processing, whether or not all the values determined for the subframes are the same is judged, and when all the values are the same, the audio signal is coded as exceptional processing, using a characteristic different from characteristics of audio signals indicated by the values.

2. The audio signal coding method according to claim 1, wherein in said performing of the subframe processing:

an identification index is coded for each of the subframes, the identification index being for identifying whether the values are the same or different between adjacent subframes; and when all the identification indices indicate that all the values are the same, the audio signal is coded as the exceptional processing, using the characteristic different from the characteristics of the audio signals indicated by the values.

3. The audio signal coding method according to claim 1, wherein in the exceptional processing, the audio signal is coded with the values assumed to monotonically increase between adjacent subframes.

4. The audio signal coding method according to claim 1, wherein in the exceptional processing, the audio signal is coded with the values assumed to monotonically decrease between adjacent subframes.

5. The audio signal coding method according to claim 1, wherein each of the values is a gain value used for normalizing the audio signal.

6. The audio signal coding method according to claim 1, wherein each of the values is a value for determining quantizing precision.

7. An audio signal decoding method for decoding a coded sequence of an audio signal coded using the audio signal coding method according to claim 1, said audio signal decoding method comprising identifying that the exceptional processing has been performed and decoding the coded sequence, in the case where the coded sequence has been coded in the subframe processing.

8. An audio signal coding apparatus which codes an audio signal to be coded, said apparatus comprising:

a judging unit configured to judge for each of frames whether or not coding should be performed on each of two or more subframes into which the frame is divided, based on an audio signal contained in the frame into which the audio signal to be coded is divided for every set of samples; and a subframe processing unit configured to, when judged that the coding should be performed on each of the subframes, perform, for each subframe, subframe processing of (i) determining a value representing a characteristic of an audio signal of the subframe, and (ii) coding the audio signal using the determined value, wherein said subframe performing unit is configured to judge whether or not all the values determined for the subframes are the same, and when all the values are the same, code the audio signal as exceptional processing, using a characteristic different from characteristics of audio signals indicated by the values.

9. An audio signal decoding apparatus which decodes a coded sequence of an audio signal coded by the audio signal coding apparatus according to claim 8, said audio signal decoding apparatus comprising a decoding unit configured to identify that the exceptional processing has been performed and decode the coded sequence, in the case where the coded sequence has been coded in the subframe processing.

10. A non-transitory computer-readable medium having a program stored thereon for causing a computer to execute an audio signal coding method for coding an audio signal to be coded, the method comprising:

judging, using a judging unit, for each of frames whether or not coding should be performed on each of two or more subframes into which the frame is divided, based on an audio signal contained in the frame into which the audio signal to be coded is divided for every set of samples; and when judged that the coding should be performed on each of the subframes, performing, using a subframe processing unit, for each subframe, subframe processing of (i) determining a value representing a characteristic of an audio signal of the subframe, and (ii) coding the audio signal using the determined value, wherein in the performing of the subframe processing, whether or not all the values determined for the subframes are the same is judged, and when all the values are the same, the audio signal is coded as exceptional processing, using a characteristic different from characteristics of audio signals indicated by the values.

* * * * *